US006253929B1

(12) United States Patent
Nemedi et al.

(10) Patent No.: US 6,253,929 B1
(45) Date of Patent: Jul. 3, 2001

(54) WET CHIP CENTRIFUGAL SEPARATOR SUSPENSION SYSTEM

(75) Inventors: William D. Nemedi, Paw Paw; Robert J. Nemedi, Kalamazoo, both of MI (US)

(73) Assignee: Inter-Source Recovery Systems, Inc., Kalamazoo, MI (US)

( * ) Notice: Subject to any disclaimer, the term of this patent is extended or adjusted under 35 U.S.C. 154(b) by 0 days.

(21) Appl. No.: 09/504,480

(22) Filed: Feb. 15, 2000

(51) Int. Cl.[7] ..... B04B 1/00; B04B 9/14

(52) U.S. Cl. ..... 210/373; 210/380.1; 494/36; 494/43; 494/46

(58) Field of Search ..... 210/373, 380.1; 494/43, 46, 36

(56) References Cited

U.S. PATENT DOCUMENTS

Re. 35,307 7/1996 Nemedi ..... 494/43

*Primary Examiner*—David A. Reifsnyder
(74) *Attorney, Agent, or Firm*—Marshall, O'Toole, Gerstein, Murray & Borun

(57) ABSTRACT

A suspension assembly for suspending components of a centrifugal separator from a floor or base plate. The assembly comprises two shafts fixed to each other at 90°, each shaft being disposed in bearing assemblies attached to the floor plate or pivot plate.

13 Claims, 4 Drawing Sheets

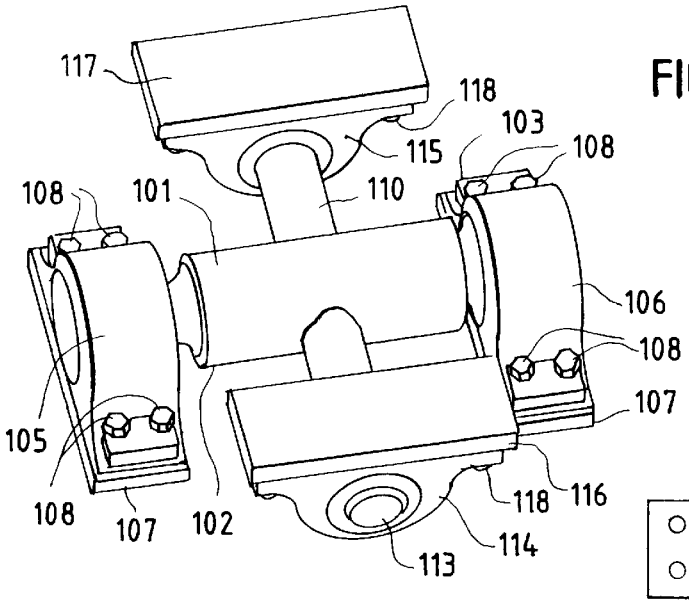
FIG. 4
FIG. 5
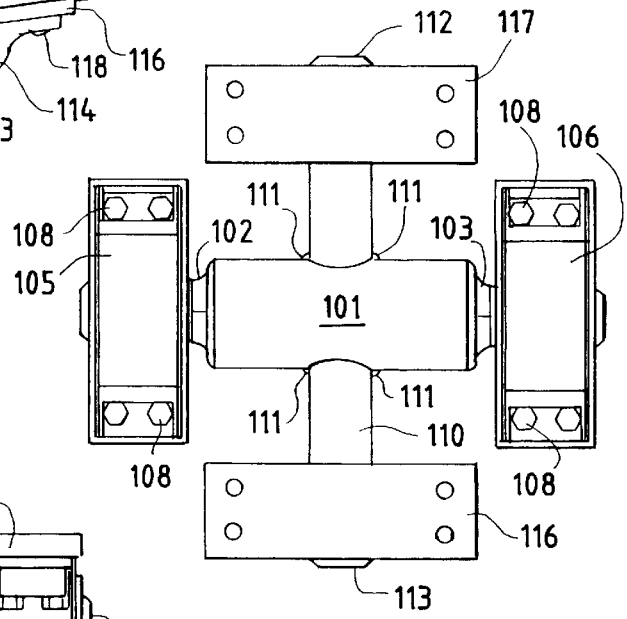
FIG. 7
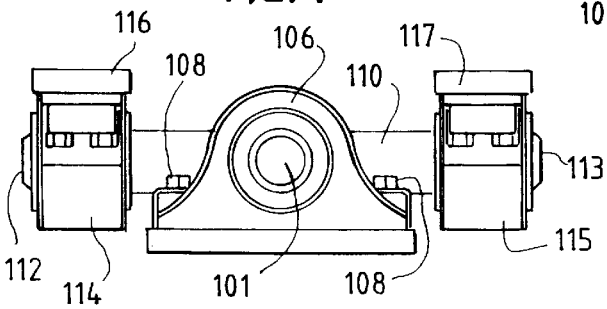
FIG. 6
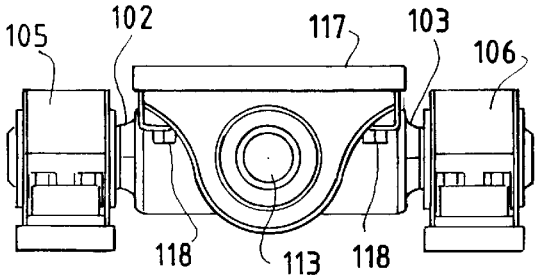
FIG. 8
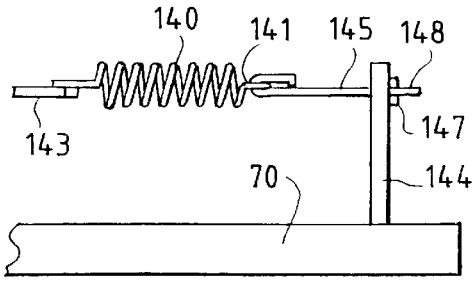

WET CHIP CENTRIFUGAL SEPARATOR SUSPENSION SYSTEM

BACKGROUND OF THE INVENTION

The present invention is directed to an improved base suspension system for a wet chip centrifugal separator. More particularly, the invention is directed to a suspension base arrangement for a centrifugal separator which serves to accommodate the range of machine motions generated in the course of a wet chip separation operation.

In machining operations involving machines such as a lathe, milling machine, or router, a piece of metal or plastic stock is worked and a substantial scrap byproduct is generated. The scrap material generally comprises elongated helical or other shaped pieces saturated with lubricant or coolant fluid. Often, the scrap material constitutes cast iron, aluminum, or brass chips with lubricating or coolant fluid adhering to the chips. Such chips are referred to as wet chips.

In conventional chip processing systems, the scrap material generally is conveyed or otherwise transported to a centrifugal separator where the wet chips are centrifuged whereby fluid is substantially separated from the chips. Recovered fluid often is recirculated in the system while the dried chips are collected at a recovery site for further disposition. An example of a centrifugal separator or wringer presently employed is exemplified and illustrated in Nemedi U.S. Reissue Pat. No. 35,307, the entire disclosure and drawings of which are incorporated herein by reference.

In wet chip separation, a centrifuge sometimes is subjected to vibration and other forces. Accordingly, it has been necessary to mount the separator, including its various mechanical components, in a manner which accommodates for such forces and vibrations. Wet chip separators, as illustrated in the aforesaid '307 reissue patent, have utilized a ball and socket suspension system to mount the centrifuge, whereby it can satisfactorily accommodate these forces generated in the course of a wet chip centrifuge operation. In this particular prior art system, a floor or first base plate resides on the floor of the separator housing. A socket is affixed to the floor plate and a ball unit having a pivot plate affixed to it is disposed within the socket. Various mechanical components of the separator are mounted directly or indirectly on the pivot plate such that the ball and socket serve as a load bearing suspension unit. Additionally, the ball unit is adapted to rotate about and pivot in the socket thereby providing for a desired orbital motion of the pivot plate. This ball/socket suspension system has worked satisfactorily in various centrifugal wet chip separator systems.

Wet chip centrifugal separators have been sold which utilize different size wringer bowls of varying diameters, i.e., 20, 30, and 40 inch. The centrifuge or wringer bowls receive the wet chips to be separated. Recently, wet chip applications call for increased size centrifugal separators which can handle an increased amount of wet chips in the wringer bowl. As a result, the overall size of the centrifugal separator, as well as the various components of the separator, increases to accommodate a larger bowl. Specifically, it is desired to have a bowl size or diameter of about 50 inches. However, problems have arisen in attempting to provide a larger size separator. First, not only is the bowl size increased, thereby increasing the overall size and weight of the unit, it has been found that the ball and socket suspension arrangement is not particularly satisfactory for use with these larger size units. What has been found is that in going to an increased separator size, the ball and socket suspension arrangement satisfactorily supports only a certain load while providing a limited range of pivot plate movement. Further, the increased weight of the large size separator increases the frictional force generated between the ball and socket resulting in undesired wear problems and, potentially, increased power to actuate the unit. Finally, wear on the ball causes a reduction in the desired machine coordinates or stacking dimensions, i.e., vertical dimension of the overall unit components. This reduction adversely affects the desired operational machine clearance causing difficulties in properly balancing the centrifuge. Improper machine component balance can, in some instances, cause the machine to unduly vibrate or wobble which ultimately can lead to the malfunction of the separator. To overcome an improperly balanced suspension system which employs a ball socket arrangement, the centrifugal separator has to be disassembled and the ball and/or socket replaced.

What is desired is to overcome the aforementioned wet chip centrifugal separator suspension problems with a suspension system that will tolerate increased machine size and weight. It also is desired to have a wet chip separator suspension system which allows the separator to provide the desired epicyclical movement of the rotating components of the wringer while minimizing balance and wear problems.

SUMMARY OF THE INVENTION

The invention disclosed and claimed herein serves to obviate the above-referenced problems sometimes found with wringers utilizing a ball and socket suspension arrangement and achieve the sought after desires for a wet chip centrifugal separator processing system. With the present invention, the ball and socket suspension arrangement is replaced with a dual shaft suspension arrangement where the shafts are offset to one another by 90°. One of the shafts is disposed for rotation in bearings located at opposite ends of the first shaft, the bearings being disposed in bearing assemblies affixed to a centrifugal separator floor plate. The remaining or second shaft extends through an opening in the first shaft and is substantially perpendicular and fixed to the first shaft. Each end of the second shaft is mounted in a bearing assembly affixed to a wringer pivot plate, which is spaced from the floor plate, such that the first shaft rotates within its respective bearing assemblies and the wringer pivot plate articulates as required when the machine is in operation including wet chip separation.

Mechanical components of the wringer are mounted directly or indirectly to the wringer pivot plate. The suspension units, i.e., shafts, bearing assemblies, plates, can be sized by a person of ordinary skill in the art of chip separator construction, to withstand the dynamic loads and vibrations generated by a large size separator, e.g., 50 inch bowl. Additionally, the dual shaft arrangement permits the pivot plate to accommodate the range of pivot plate movement that normally can be expected to occur in the course of a wet chip separation operation.

These and other features, advantages, and objects of the present invention will be further understood and appreciated by those skilled in the art by reference to the following specification, drawings, and claims.

BRIEF DESCRIPTION OF THE DRAWINGS

FIG. 4 shows a perspective view of the dual shaft centrifugal separator suspension system of the present invention;

FIG. 5 shows a plan view of the dual shaft suspension system of FIG. 4;

FIG. 6 shows an end elevation view of the dual shaft suspension system of FIG. 4;

FIG. 7 shows a side elevation view of the dual shaft system of FIG. 4; and, FIG. 8 shows a schematic view of a torsion spring mounting assembly employed with the suspension assembly pivot plate.

DETAILED DESCRIPTION

Figure 1:
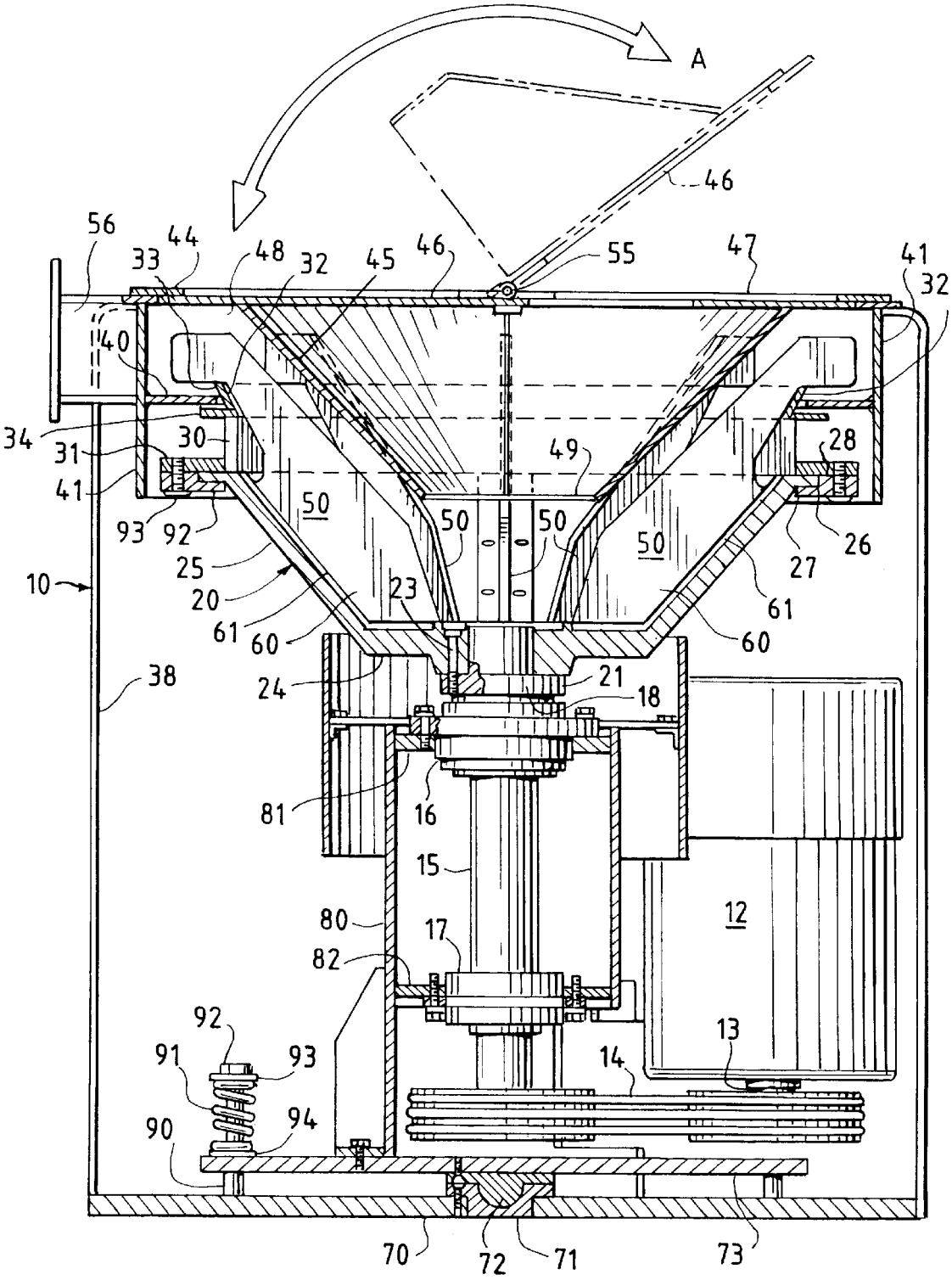
FIG. 1 shows a vertical view of a prior art wet chip centrifugal separator employing a ball and socket suspension arrangement.

Referring to the drawings and particularly FIG. 1, there is shown a centrifugal separator device 10 which includes motor 12 having a drive shaft 13 connected by belt and pulley drive assembly 14 to one end of centrifugal separator drive shaft 15. Shaft 15 is disposed within two bearing assemblies 16, 17.

Hub 18 is fixedly disposed on the remaining end of drive shaft 15 and a substantially bell-shaped separator bowl 20 is seated on flange 21 of hub 18. Separator or wringer bowl 20 has an opening 22 which permits bowl 20 to seat on hub 18 as to provide a close fit between the bowl opening and hub 18. A plurality of bolts 23 serve to releasably fasten the bowl to hub 18 whereby, upon actuation of motor 12, bowl 20 connected to shaft 15, rotates.

Bottom wall 24 of separator bowl 20, which has inner and outer wall surfaces, extends outwardly and terminates in bowl wall 25 which extends vertically upwardly and outwardly. Mounting flange 26 is located at the end 27 of bowl wall 25. Bowl wall 25 also has an inner and outer wall surface.

A substantially cylindrical and porous separator screen 30, which is defined by a wire mesh or the like having openings therein to permit passage of lubricant or other fluids therethrough without permitting passage of shavings, chips or other materials, extends upward from flange 26. Screen 30 is secured to flange 26 by means of a plurality of fasteners 28.

A conical portion 32 is secured to the upper edge of screen 30 extends radially outward in an upward direction to a dispensing edge 33. A radially extending flange 34 is secured to the centrifugal separator bowl 20 intermediate the juncture between conical portion 32 and screen 30.

Liquid discharged through the openings in screen 30 will be collected in a suitable collection chamber, not shown, preferably disposed within casing chamber 38 in which the parts separator device is disposed.

A radially, inwardly directed flange 40 is secured to cylindrical wall member 41 which depends from and is attached to the top of chamber 38 as seen in FIG. 1. Cover 44 is fixed in any desired manner to the upper edge of chamber 38. In this particular embodiment, cover 44 includes an upper conical member 45 which is fixedly attached to and depends from cover 44. Conical member 45 comprises two pivotable cone-shaped portions 46, 47 whereby the outer wall of conical member 45 defines the inner wall of a second annular chip collecting chamber 48 and the cylindrical wall member 41 defines the outer wall thereof.

Cone 45 converges in a downward direction to a location spaced immediately above and within separator bowl 20. Opening 49 at the bowl end of conical member 45 defines an air inlet as well as a material inlet for shavings, chips or the like into centrifuge 10.

Spaced blade assemblies 50 are securely fastened to and rotate with rotatable separator bowl 20.

In a typical operation, metal chips and lubricating fluids are delivered to the top of centrifuge 10. The mixed chips and fluids enter centrifuge 10 and pass through conical member 45 which, as illustrated in FIG. 1, is in an open position with hinged cone portion 46 pivoted at 55, in the position located in the direction of arrow A. The fluid mixed with the metal chips passes into rotating separator bowl 20 where the wet chips to be separated are forced outwardly and upwardly along the internal wall of bowl 20 and the leading surface of blades 60. Lubricating fluid is separated from the chips and passes through screen 30 to a collection chamber (not shown). The dried chips are directed upward over screen 30, pass dispensing edge 33 where they are blown out of chamber 48, exit chute 56, and pass to a collecting site.

Motor 12 is mounted on a post, not shown, which is connected at one end thereof to base or floor plate 70. Also attached to plate 70 by suitable screws is socket 71. A ball unit 72 is disposed for rotation and pivoting in socket 71. Ball unit 72 also is connected by suitable screws to pivot plate 73 whereby pivot plate 73 is adapted for a range of motion relative to base plate 70.

As illustrated in FIG. 1, a bearing cartridge 80 is fixed to pivot plate 73. Spaced, horizontal bearing support plates 81, 82, upon which motor shaft bearing assemblies 16, 17 are respectively located, are fixed by welding or other suitable means to cartridge 80 whereby various mechanical components, e.g., shaft 15, bowl 20, and blade assemblies 50 are indirectly attached to pivot plate 73.

A post 90 having one end affixed to base plate 70 extends upward through an opening in pivot plate 73. A torsion spring 91 is positioned on post 90. One end of spring 91 rests on a washer 94 seated on pivot plate 73. A nut 92 is fastened to the open threaded end of post 90 at the location of washer 93 to place a desired tension on pivot plate 73. If desired, more than one pivot plate tensioning unit can be employed.

Figure 2:
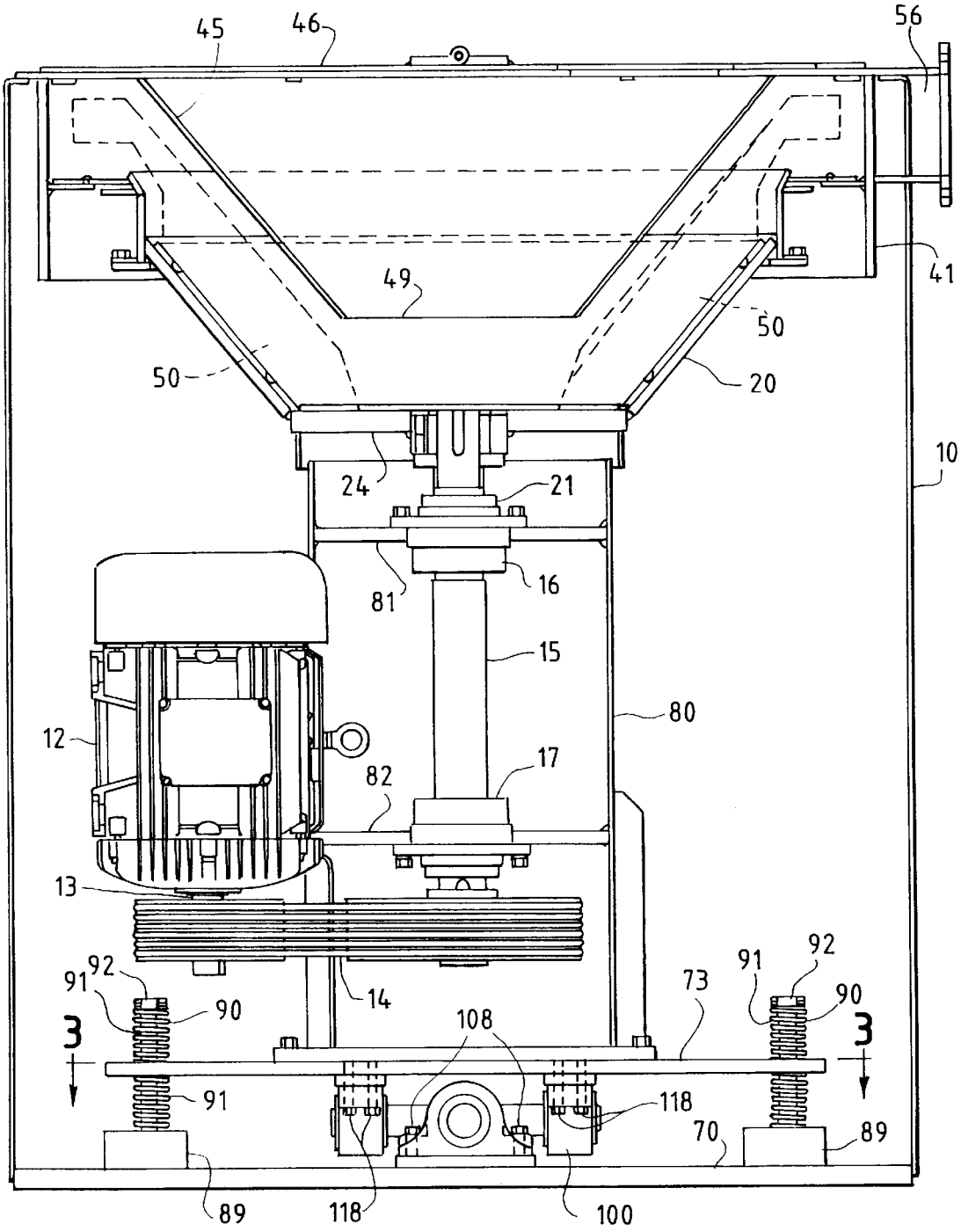
FIG. 2 shows a vertical view of a centrifugal separator employing the dual bearing assembly suspension arrangement of the present invention.

Turning to FIG. 2, the centrifugal separator of FIG. 1 is illustrated. Motor 12 is attached to a vertical post, not shown, one end of which is fixed to floor or base plate 70. Brackets, not shown, connect motor 12 to the post. A dual shaft suspension assembly 100 replaces the ball socket suspension arrangement of FIG. 1. Suspension assembly 100, see also FIGS. 4–7, includes a first shaft 101 whose ends 102, 103 are of reduced diameter. Shaft ends 102, 103 are each disposed for rotation in respective first bearing assemblies 105, 106. Bearing assemblies 105, 106 each are disposed on a mounting pedestal 107 with pedestals 107 being affixed to floor plate 70 by threaded bolts or other suitable fasteners 108.

A second shaft 110 is adapted to extend through an opening in shaft 101 and is fixed in place substantially perpendicular to shaft 101 by welding shaft 101 to shaft 110 at 111. The two ends 112, 113 of shaft 110 are disposed in respective second bearing assemblies 114, 115. Bearing assemblies 114, 115 are positioned on pedestals 116, 117, respectively, with the assemblies and pedestals being releasably maintained on the underside of pivot plate 73 by threaded bolts 118 whereby plate 73 pivots about second shaft 110.

Spring assemblies 96 preferably are employed to maintain a compressive force on pivot plate 73 at the location of the spring assemblies. A plurality of posts 90, each suitably affixed to block 89, which, in turn, is mounted to floor plate 70, extend upward through openings in pivot plate 73. A pair of coil springs 91 are disposed on each post, the springs being separated by pivot plate 73. An adjusting nut 92 is threaded onto each post whereby the springs are compressed the desired amount to ensure that the desired compression and tension is placed on plate 73.

Figure 3:
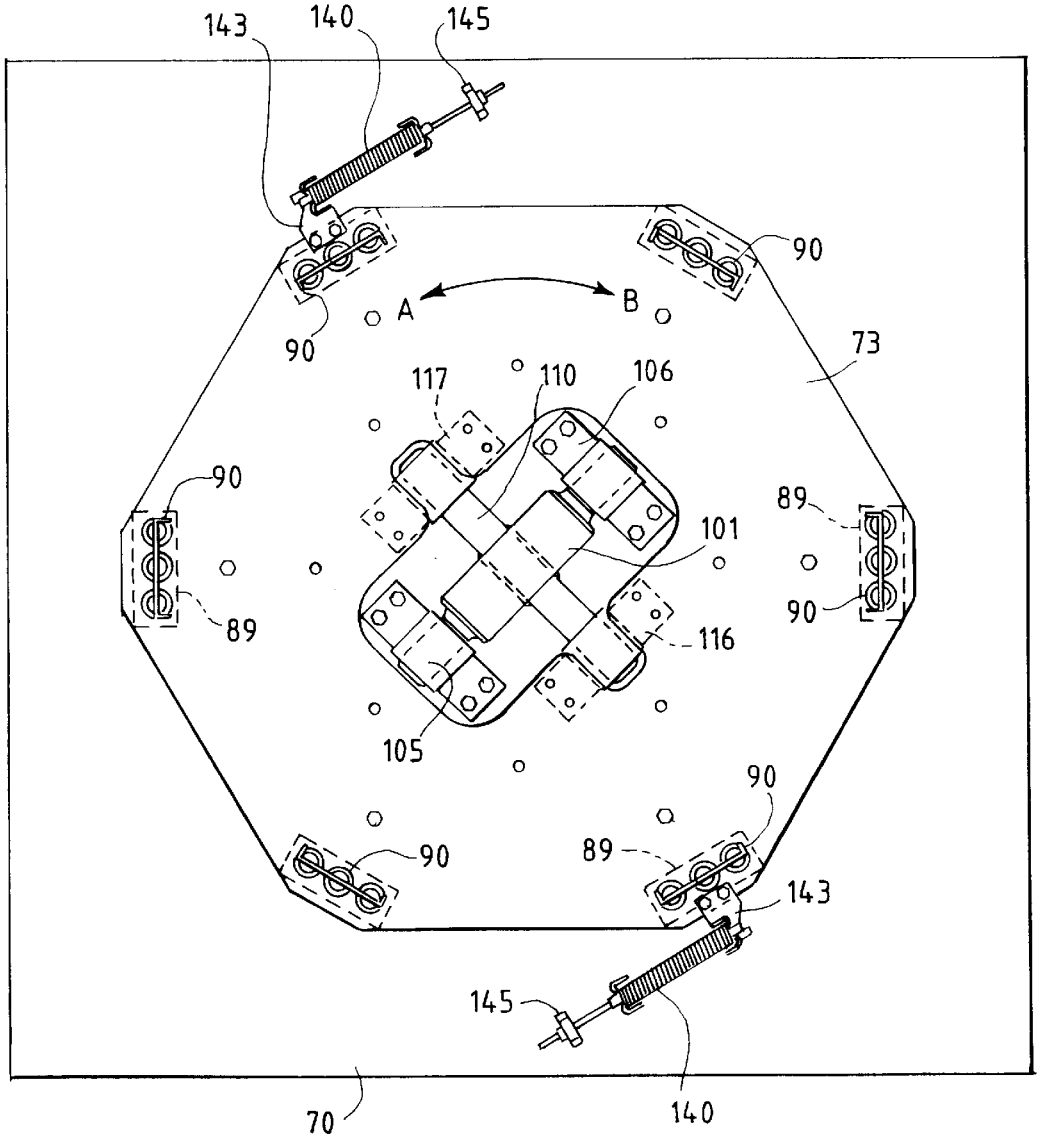
FIG. 3 shows a plan view taken along lines 3—3 in FIG. 2 of the suspension assembly pivot plate.

Similarly, as seen more clearly in FIGS. 3 and 8, a second set of torsion spring assemblies 140 can be utilized in the system. Each spring assembly 140 has one end 141 attached by any suitable means, e.g., J-shaped fastener connected to the spring at one end and to a vertical mounting bracket 144 at the remaining end. Bracket 144 extends upward from and is mounted to plate 70. Nut 148 holds the fastener to the bracket 144. The opposite remaining spring end is similarly attached by a suitable fastener, e.g., J-shaped fastener, to a mounting bracket 143 which is fixed to and extends from plate 73. Two spring assemblies 140 are illustrated in FIG. 3. If, in operation of the centrifuge, plate 73 attempts to rotate in the direction of arrows A-B, it is precluded from rotating beyond a desired amount by the respective spring assemblies 140 located 180° from one another.

While the present invention has been described with reference to the specific examples, which are intended to be illustrative only and not to be limiting of the invention, it will be apparent to those of ordinary skill in the art that changes, additions, and/or deletions may be made to the disclosed embodiment without departing from the spirit and scope of the invention.

What is claimed is:

1. A suspension assembly for a wet chip separator, said assembly comprising:

a first shaft having two ends;

a first bearing assembly joined to one end of said first shaft, a second bearing assembly joined to the remaining end of said first shaft, whereby said first shaft rotates in said first and second bearing assemblies;

said first shaft having an opening therein;

a second shaft having two ends;

said second shaft disposed within said first shaft opening;

a third bearing assembly joined to one end of said second shaft; and, a fourth bearing assembly joined to the remaining end of said second shaft.

2. A suspension assembly in accordance with claim 1 wherein said second shaft is fixed to said first shaft.

3. A suspension assembly for a wet chip separator, said assembly comprising:

a first shaft having two ends;

a first bearing assembly joined to one end of said first shaft, a second bearing assembly joined to the remaining end of said first shaft, whereby said first shaft rotates in said bearing assemblies;

a second shaft having two ends;

said second shaft being positioned substantially perpendicular to said first shaft;

a third bearing assembly joined to one end of said second shaft; and, a fourth bearing assembly joined to the remaining end of said second shaft.

4. A suspension assembly in accordance with claim 1 or 3 in which plate is joined to one of said bearing assemblies joined to one of said shafts and a support member is joined to said remaining shaft bearing assemblies.

5. A suspension assembly for a wet chip centrifugal separator comprising a rotatable bowl fixed to a rotatable shaft which is indirectly fixed to a pivot plate spaced from a base plate, said suspension assembly comprising:

a first shaft having two ends;

a first bearing assembly joined to one end of said first shaft, a second bearing assembly joined to the remaining end of said first shaft, whereby said first shaft is adapted to rotate in said first and second bearing assemblies;

a second shaft having two ends;

said second shaft being positioned substantially perpendicular to said first shaft;

a third bearing assembly joined to one end of said second shaft; and said first and second bearing assemblies for joining to said pivot plate and said third and fourth bearing assemblies for joining to said base plate whereby said plates are spaced from one another and movement can occur between said plates in a wet chip separation operation.

6. A wet chip separator suspension system in accordance with claim 5 in which said first and second shafts are fixed to one another.

7. A wet chip separator suspension system in accordance with claim 6 in which said first shaft bearing assemblies are fixed to said pivot plate and said second shaft bearing assemblies are fixed to said base plate.

8. A centrifugal separator for separating wet chips into dry chips, said centrifugal separator comprising:

a rotatable bowl;

a screen disposed on said bowl;

a plurality of spaced blade assemblies affixed to said bowl for rotation with said bowl;

a rotatable shaft connected to said bowl for rotating said bowl, said shaft being provided in at least one bearing assembly;

a support assembly for supporting said shaft bearing assembly;

a motor for actuating rotation of said shaft;

members connecting said shaft to said motor;

a pivot plate having said support assembly connected thereto;

a floor plate spaced from said pivot plate; and, a suspension assembly disposed between said floor and pivot plates; said suspension assembly comprising:

a first shaft having two ends;

a pair of spaced first bearing assemblies mounted to said floor plate; each first assembly having a bearing therein;

one end of said first shaft disposed for rotation in one of said first assembly bearings and the remaining first shaft end mounted in said remaining first assembly bearing for rotation therein;

a second shaft having two ends;

said second shaft being disposed substantially perpendicular to and fixed to said first shaft;

a pair of spaced second bearing assemblies mounted to said pivot plate; each second assembly having a bearing therein;

one end of said second shaft disposed for rotation in one of said second assembly bearings and the remaining second shaft end being disposed for rotation in said remaining second assembly bearing for rotation therein;

whereby in a wet chip operation, said pivot plate is adapted to move relative to said floor plate.

9. A centrifugal separator in accordance with claim 8 wherein said first shaft has an opening and said second shaft extends through said opening and is fixed to said first shaft.

10. A centrifugal separator in accordance with claim 8 and further including at least one spring compression assembly disposed at least partially between said floor and pivot plates.

11. A centrifugal separator in accordance with claim 10 wherein a plurality of spring compression assemblies are spaced from one another and at least partially disposed between said floor plate and pivot plate.

12. A centrifugal separator in accordance with claims 8 or 9 wherein at least one torsion spring assembly connects said floor plate and said pivot plate.

13. A centrifugal separator in accordance with claim 12 wherein a plurality of torsion spring assemblies are spaced from one another and each assembly is connected to said floor plate and pivot plate.

* * * * *